US012686528B2

(12) United States Patent
Beacham

(10) Patent No.: US 12,686,528 B2
(45) Date of Patent: Jul. 21, 2026

(54) PALLET FOR HIGH CENTER OF GRAVITY LOADS

(71) Applicant: GE Precision Healthcare LLC, Waukesha, WI (US)

(72) Inventor: Jimmie Beacham, West Allis, WI (US)

(73) Assignee: GE Precision Healthcare LLC, Waukesha, WI (US)

( * ) Notice: Subject to any disclaimer, the term of this patent is extended or adjusted under 35 U.S.C. 154(b) by 119 days.

(21) Appl. No.: 18/527,817

(22) Filed: Dec. 4, 2023

(65) Prior Publication Data

US 2025/0178782 A1 Jun. 5, 2025

(51) Int. Cl.

| | |
|---|---|
| ***B65D 19/38*** | (2006.01) |
| ***B65D 19/00*** | (2006.01) |
| ***B65D 85/68*** | (2006.01) |

(52) U.S. Cl.

CPC ..... *B65D 19/38* (2013.01); *B65D 19/0026* (2013.01); *B65D 85/68* (2013.01); *B65D 2519/00796* (2013.01); *B65D 2585/6897* (2013.01)

(58) Field of Classification Search

CPC .... B65D 19/38; B65D 19/0026; B65D 85/68; B65D 2519/00796; B65D 2585/6897

USPC ..... 108/51.11

See application file for complete search history.

(56) References Cited

U.S. PATENT DOCUMENTS

| | | | | | |
|---|---|---|---|---|---|
| 2,873,935 | A * | 2/1959 | De Pew | B65D 19/38 | 108/57.17 |
| 3,216,531 | A * | 11/1965 | Hutchinson | B62B 5/049 | 280/47.35 |
| 4,073,369 | A * | 2/1978 | Nordskog | B62B 5/049 | 188/32 |
| 4,485,522 | A * | 12/1984 | Chen | E05F 3/20 | 16/303 |
| 5,076,175 | A | 12/1991 | Whatley, II | | |
| 5,152,029 | A * | 10/1992 | Pai | E05F 3/20 | 16/54 |
| 5,419,013 | A * | 5/1995 | Hsiao | A47K 13/12 | 16/319 |

(Continued)

FOREIGN PATENT DOCUMENTS

| | | | | |
|---|---|---|---|---|
| GB | 2416527 A * | 2/2006 | | B65D 19/44 |
| KR | 102365332 B1 * | 8/2018 | | |
| WO | WO-2008111041 A2 * | 9/2008 | | B62B 5/049 |

*Primary Examiner* — Daniel J Troy
*Assistant Examiner* — Timothy M Ayres
(74) *Attorney, Agent, or Firm* — Fletcher Yoder, P.C.

(57) ABSTRACT

A pallet configured for a high center of gravity load includes a deck having a first side, a second side, a third side, and a fourth side. Both the first side and the second side extend between both third side and the fourth side. The pallet includes a plurality of support structures coupled to and disposed underneath the deck. The pallet includes a second door coupled to and centrally disposed along the second side. The first door and the second door are each configured to move between an open position and a closed position, the closed position being configured to block forks of a forklift from accessing a central space underneath the deck that is unstable for lifting the high center of gravity load disposed on the pallet with the forklift, and the open position being configured to enable forks of a pallet jack to access the central space.

20 Claims, 6 Drawing Sheets

(56) References Cited

U.S. PATENT DOCUMENTS

| | | | | |
|---|---|---|---|---|
| 6,637,351 | B1 * | 10/2003 | Brennan, Jr. | B65D 19/0026 108/54.1 |
| 7,607,628 | B2 | 10/2009 | Elder et al. | |
| 8,006,985 | B2 * | 8/2011 | Facey | B62B 5/0093 280/43.24 |
| 8,267,018 | B2 * | 9/2012 | Gunn | B65D 19/0024 108/51.11 |
| 8,888,109 | B2 * | 11/2014 | Stubbs | B65D 19/42 280/30 |
| 8,888,110 | B2 * | 11/2014 | Sadeh | B62B 5/0093 280/30 |
| 9,045,253 | B2 * | 6/2015 | Hacko | B62B 5/049 |
| 9,828,136 | B2 | 11/2017 | Randall et al. | |
| 9,950,726 | B2 * | 4/2018 | Thompson | B64F 1/16 |
| 10,889,407 | B2 * | 1/2021 | Soehnlen | B62B 5/0093 |
| 10,961,017 | B2 * | 3/2021 | Perkins, II | B65D 19/0012 |
| 2013/0032063 | A1 | 2/2013 | Randall et al. | |

* cited by examiner

PALLET FOR HIGH CENTER OF GRAVITY LOADS

BACKGROUND

The subject matter disclosed herein relates to a pallet for moving and transporting heavy unbalanced high center of gravity loads.

Current pallet designs may create safety concerns for moving or transporting heavy unbalanced high center of gravity loads that are susceptible to tipping in certain situations. For example, current pallet designs used for moving or transporting loads, the loads are susceptible to tipping when the load is top heavy equipment (i.e., the load has a high center of gravity). Examples of heavy unbalanced top heavy loads are imaging systems, such as computed tomography (CT) imaging systems, magnetic resonance (MR) imaging systems, positron emission tomography (PET) imaging systems, and single-photon emission computed tomography (SPECT) imaging systems that each include a gantry with a high center of gravity. Current pallet designs used for moving or transporting loads, the loads are also susceptible to tipping when forklift operators try to lift a pallet with a narrow gap between its forks instead of widely spaced forks. The components or equipment associated with CT, MR, PET or SPECT imaging systems are very expensive and tipping incidents involving this equipment can cost a provider of the equipment a significant amount of money and potentially serious injuries or deaths of people moving or transporting this equipment.

SUMMARY

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In one embodiment, a pallet configured for a high center of gravity load is provided. The pallet includes a deck having a first side, a second side disposed opposite the first side, a third side, and a fourth side disposed opposite the third side. Both the first side and the second side extend between both third side and the fourth side. The pallet also includes a plurality of support structures coupled to and disposed underneath the deck. The pallet further includes a second door coupled to and centrally disposed along the second side. The first door and the second door are each configured to move between an open position and a closed position, the closed position being configured to block forks of a forklift from accessing a central space underneath the deck that is unstable for lifting the high center of gravity load disposed on the pallet with the forklift, and the open position being configured to enable forks of a pallet jack to access the central space.

In another embodiment, a pallet configured for a high center of gravity load is provided. The pallet includes a deck having a first side, a second side disposed opposite the first side, a third side, and a fourth side disposed opposite the third side. Both the first side and the second side extend between both third side and the fourth side. The pallet also includes a plurality of support structures coupled to and disposed underneath the deck. The pallet further includes a second door coupled to and centrally disposed along the second side. The first door and the second door are each configured to move between an open position and a closed position. Both the first door and the second door are coupled to the first side and the second side respectively via respective slow self-closing hinges. The respective slow self-closing hinges are configured to respectively enable, upon opening to the open position, the first door and the second door to self-close at a rate that provides enough time for forks of a jacket pallet to access a central space underneath the deck but does not provide enough time for forks of a forklift to access the central space, and wherein the central space is unstable for lifting the high center of gravity load disposed on the pallet with the forklift.

In a further embodiment, a pallet configured for equipment of a medical imaging system having a high center of gravity is provided. The pallet includes a deck having a first side, a second side disposed opposite the first side, a third side, and a fourth side disposed opposite the third side. Both the first side and the second side extend between both third side and the fourth side. The pallet also includes a plurality of support structures coupled to and disposed underneath the deck. The pallet further includes a second door coupled to and centrally disposed along the second side. The first door and the second door are each configured to move between an open position and a closed position. The support structures include a first stopper structure centrally located underneath the deck and a second stopper structure centrally located underneath the deck. The first stopper structure and the second stopper structure are located closer to the first door and the second door respectively. The first stopper structure and the second stopper structure are respectively aligned in parallel with the first door and the second door. Both the first stopper structure and the second stopper structure are configured to block full access to forks of a forklift in a direction extending between the first side and the second side in a central space underneath the deck.

BRIEF DESCRIPTION OF THE DRAWINGS

These and other features, aspects, and advantages of the disclosed subject matter will become better understood when the following detailed description is read with reference to the accompanying drawings in which like characters represent like parts throughout the drawings, wherein.

DETAILED DESCRIPTION

Figure 1:
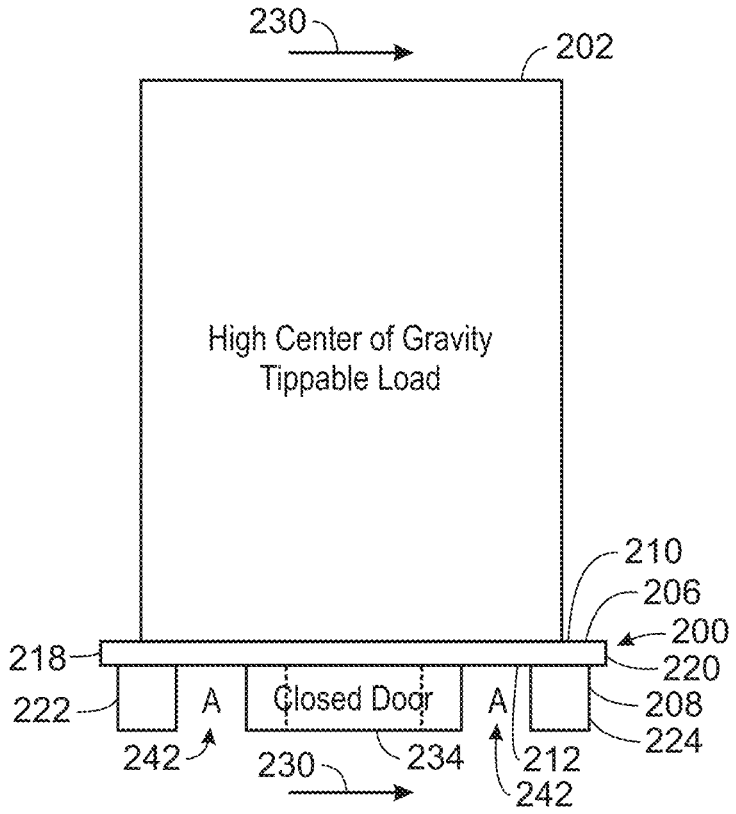
FIG. 1 is a schematic diagram of an end view of a pallet with a high center of gravity load disposed on the pallet, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

The present disclosure provides embodiments for a pallet configured for the safe lifting of high center of gravity loads (i.e., loads with the center of gravity higher (e.g., vertically) than a central point of the load that increases the chances of the load tipping over). Pallet as used in the present disclosure is a portable platform on which goods can be moved, stacked, and stored especially with the aid of a forklift and/or a pallet jack. Examples of high center of gravity loads include equipment of a computed tomography imaging system, a magnetic resonance imaging system, or other imaging systems having equipment high center of gravity loads. The configuration of the pallet ensures that forks of a forklift are inserted into pallet only at the widest possible zone by blocking the central portion using a swing type blocking door. This blocking door also opens out when a transport team needs to use a pallet jack. The door also has a slow (e.g., delayed) closing hinge to provide sufficient time for a pallet jack operator to insert forks below the pallet. The disclosed embodiments enable high center of gravity loads to be transported without tipping. Thus, the providers of equipment of medical imaging equipment reduce costs associated with equipment damaged during transport. The disclosed embodiments also makes it easier and safer to transport high center of gravity loads when a location lacks a loading dock. The disclosed embodiments enable the unloading of the high center of gravity load from a side or a back of a trailer having the pallet with the high center of gravity load.

The disclosed embodiments include a pallet configured for a high center of gravity load. The pallet includes a deck having a first side, a second side disposed opposite the first side, a third side, and a fourth side disposed opposite the third side. Both the first side and the second side extend between both third side and the fourth side. In certain embodiments, both the first side and the second side are narrower than both the third side and the fourth side. The pallet also includes a plurality of support structures coupled to and disposed underneath the deck. The pallet further includes a second door coupled to and centrally disposed along the second side. The first door and the second door are each configured to move between an open position and a closed position, the closed position being configured to block forks of a forklift from accessing a central space underneath the deck that is unstable for lifting the high center of gravity load disposed on the pallet with the forklift, and the open position being configured to enable forks of a pallet jack to access the central space.

In certain embodiments, both first door and the second door are coupled to the first side and the second side respectively via respective slow self-closing hinges. The respective slow self-closing hinges are configured to respectively enable, upon opening to the open position, the first door and the second door to self-close at a rate that provides enough time for the forks of the jacket pallet to access the central space but does not provide enough time for the forks of the forklift to access the central space.

In certain embodiments, when either the first door or the second door is in the closed position only spaces flanking the first door or the second door underneath the deck are available to the forks of the forklift. The spaces (e.g., flanking spaces) when accessed by the forks of the forklift are stable for lifting the high center of gravity load with the forklift.

In certain embodiments, wherein the support structures include a first stopper structure centrally located underneath the deck and a second stopper structure centrally located underneath the deck. The first stopper structure and the second stopper structure are located closer to the first door and the second door respectively. The first stopper structure and the second stopper structure are respectively aligned in parallel with the first door and the second door. Also, both the first stopper structure and the second stopper structure are configured to block full access to the forks of the forklift in a direction extending between the first side and the second side in the central space underneath the deck. In certain embodiments, the first stopper structure and the second stopper structure each have substantially similar lengths to the first door and the second door, respectively, in a direction between the third side and the fourth side.

In certain embodiments, a first U-shaped metal casing is disposed about a first underside and a first pair of lateral sides flanking the first underside of the first stopper structure, and a second U-shaped metal casing is disposed about a second underside and a second pair of lateral sides flanking the second underside of the second stopper structure. In certain embodiments, both the first U-shaped metal casing and the second U-shaped metal casing are configured to lower with respect to the first stopper structure and the second stopper structure to contact a surface the pallet is disposed on upon lifting of the pallet to block the forks of the forklift from extending underneath the first stopper structure and the second stopper structure respectively.

In certain embodiments, a first metal plate is disposed within the first stopper structure and a second metal plate is disposed within the second stopper structure, wherein both the first metal plate and the second metal plate are configured to contact a surface the pallet is disposed on upon lifting of the pallet to block the forks of the forklift from extending underneath the first stopper structure and the second stopper structure respectively.

Figure 2:
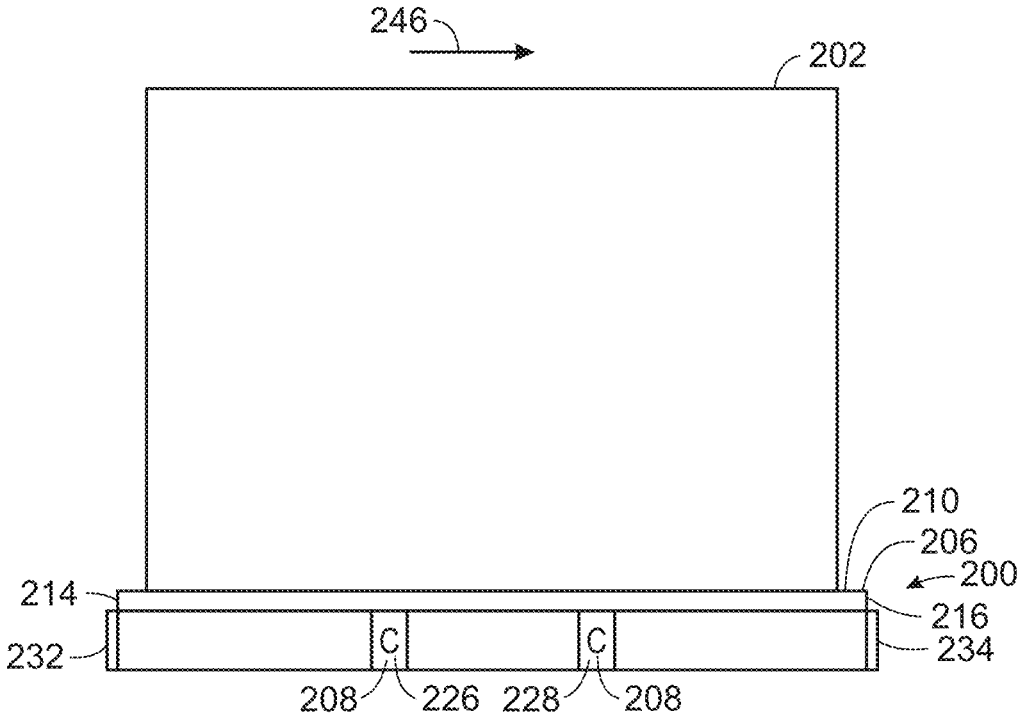
FIG. 2 is a schematic diagram of a side view of the pallet with the high center of gravity load disposed on the pallet in FIG. 1, in accordance with aspects of the present disclosure.
Figure 3:
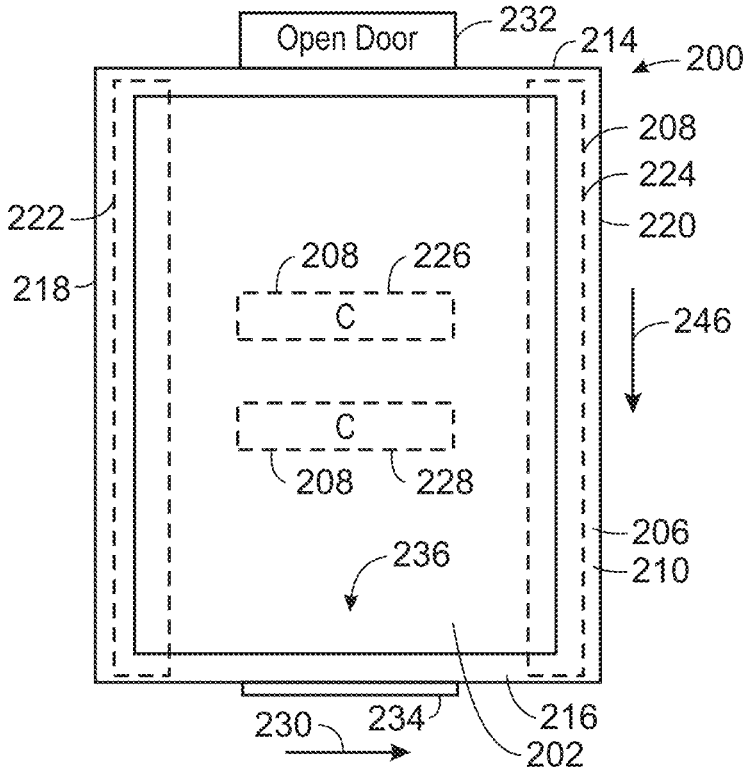
FIG. 3 is a schematic diagram of a top view of the pallet in FIG. 1, in accordance with aspects of the present disclosure.
Figure 12:
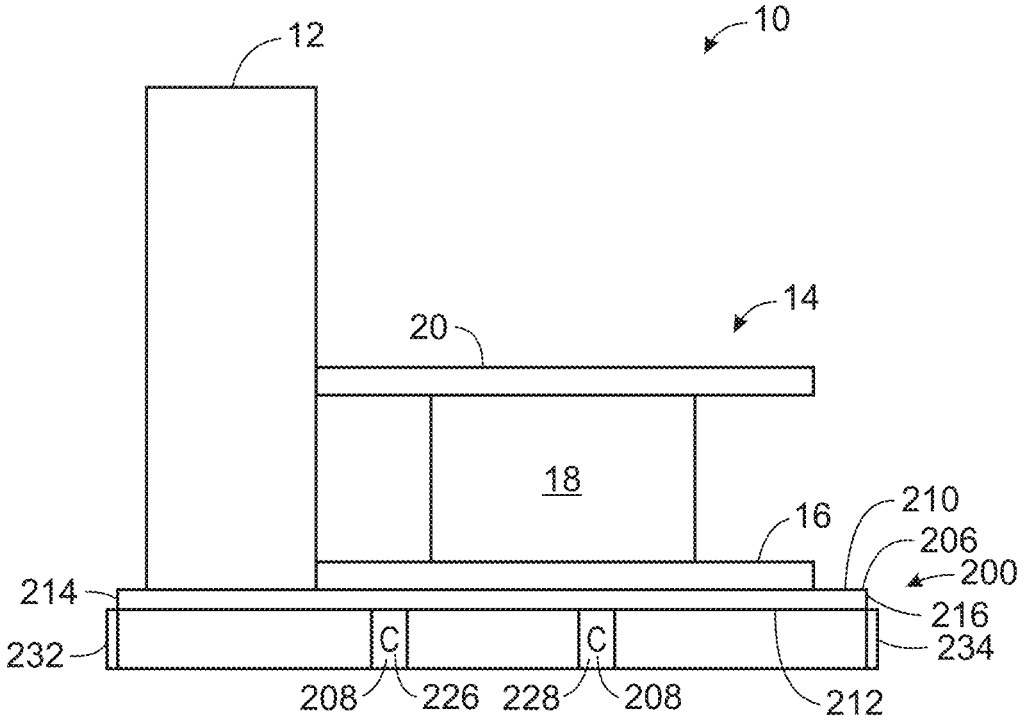
FIG. 12 is a schematic diagram of a side view of a pallet with an imaging system disposed on the pallet, in accordance with aspects of the present disclosure.

With the preceding in mind, FIGS. 1-4 are different views of a pallet 200 configured for safe lifting of a high center of gravity load 202 (e.g., high center of gravity tippable load). FIGS. 1-3 depict the high center of gravity load 202 disposed on the pallet 200. The high center of gravity of load 202 is not depicted on the pallet 200 in FIG. 4 for clarity. Examples of high center of gravity loads 202 include equipment of a computed tomography imaging system, a magnetic resonance imaging system, or other imaging systems having equipment high center of gravity loads. FIG. 12 provides an example of an imaging system that is disposed on a pallet that may include equipment that serve as high of center of gravity loads 202.

The pallet 200 includes a deck 206 and a plurality of support structures 208. The pallet 200 includes a top side 210 and an underside 212. The plurality of support structures 208 are coupled to the underside 212 of the deck 206 and are configured to be disposed on the ground or a surface. The high center of gravity load 202 is disposed on the top side 210 of the deck 206. The plurality of support structures 208 are configured to support the deck 206 and the high center of gravity load 202.

The deck 206 has a first side 214, a second side 216 disposed opposite the first side 214, a third side 218, and a fourth side 220 disposed opposite the third side 218. Both the first side 214 and the second side 216 extend between both the third side 218 and the fourth side 220. As depicted, both the first side 214 and the second side 216 are narrower than both the third side 218 and the fourth side 220. In certain embodiments, the first side 214, the second side 216, the third side 218, and the fourth side 220 are the same length. In certain embodiments, both the third side 218 and the fourth side 220 are narrower than the first side 214 and the second side 216.

The plurality of support structures 208 includes a first support structure 222 disposed adjacent to and extending along the underside 212 of the third side 218 of the deck 206. The plurality of support structures 208 also includes a second support structure 224 disposed adjacent to and extending along the underside 212 of the fourth side 220 of the deck 206. The support structures 222 and 224 are not shown in FIGS. 2 and 5 for clarity. As depicted, the first support structure 222 and the and the second support structure 224 extend along a majority of a respective length of the third side 218 and the fourth side 220, respectively. The number of support structures 208, the placement of the support structures 208, and the length of the support structures 208 may vary from those depicted in FIGS. 1-4. In certain embodiments, a plurality of shorter support structures 208 may be disposed adjacent to and extending along the underside 212 of the third side 218 of the deck 206. Also, in certain embodiments, a plurality of shorter support structures 208 may be disposed adjacent to and extending along the underside 212 of the fourth side 220 of the deck 206. In certain embodiments, smaller support structures 208 may only be disposed on the underside 212 of the deck 206 adjacent the corners (e.g., adjacent where the first side 214 and the third side 218 meet, adjacent where the first side 214 and the fourth side 220 meet, adjacent where the second side 216 and the third side 218 meet, and adjacent where the second side 216 and the fourth side 220 meet).

The plurality of support structures 208 also includes a first stopper structure 226 (e.g., first stopper block represented by C) centrally located on the underside 212 of the deck 206. The plurality of support structures 208 further includes a second stopper structure 228 (e.g., second stopper block represented by C) centrally located on the underside 212 of the deck 206. The first stopper structure 226 and the second stopper structure 228 are oriented with their respective longitudinal lengths extending in a direction 230 between the third side 218 and the fourth side 220. The first stopper structure 226 and second stopper structure 228 (along their longitudinal lengths) are in parallel alignment with both the first side 214 and the second side 216. The first stopper structure 226 is disposed closer to the first side 214 than the second stopper structure 228. The second stopper structure 228 is disposed closer to the second side 216 than the first stopper structure 226.

Figure 4:
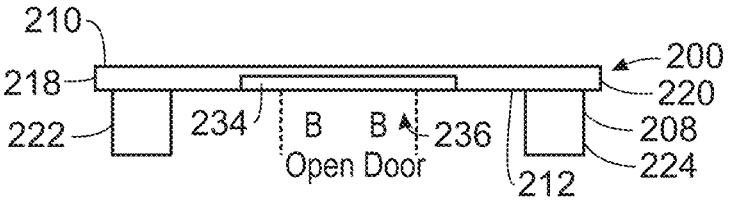
FIG. 4 is a schematic diagram of an end view of the pallet in FIG. 1 (having an open door), in accordance with aspects of the present disclosure.
Figure 5:
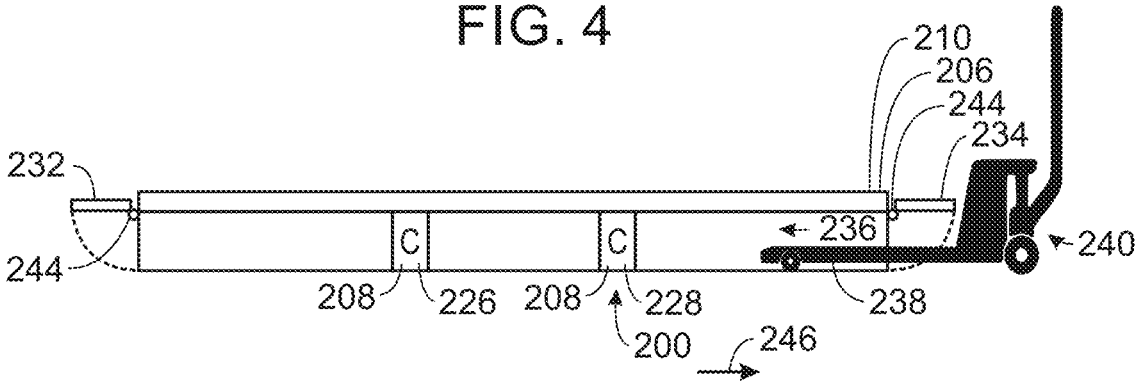
FIG. 5 is a schematic diagram of a side view of pallet being utilized with a pallet jack, in accordance with aspects of the present disclosure.

As depicted, the pallet 200 includes a first door 232 (e.g., first slow self-closing door) coupled to and centrally disposed along the first side 214. The pallet 200 also includes a second door 234 (e.g., second slow self-closing door) coupled to and centrally disposed along the second side 216. Both the first door 232 and the second door 234 are configured to move between an open position (e.g., with the respective door parallel to the deck 206 as depicted in FIGS. 3 and 4) and a closed position (e.g., with the respective door extending in a direction perpendicular to the deck 206 as depicted in FIGS. 1-3). In the closed position, the first door 232 and the second door 234 are each configured to block forks of a forklift from accessing a central space 236 (represented by B) underneath the deck 206. The central space 236 is unstable for lifting the high center of gravity load 202 with the forklift. In the open position, the first door 232 and the second door 234 are each configured to enable forks of a pallet jack to access the central space 236 for transport of the high center of gravity load 202 on pallet 200 by the pallet jack. FIG. 5 depicts forks 238 of a pallet jack 240 being disposed into the central space 236 via an open second door 234.

Returning to FIGS. 1-4, when either the first door 232 or the second door 234 is in the closed position only spaces 242 (represented by A) flanking the respective door are available to the forks of the forklift to be inserted underneath the deck 206. These spaces 242 when utilized or accessed by the forks of the forklift are stable for lifting the high center of gravity load 202 and transporting the high center of gravity load 202 with the forklift.

Both the first door 232 and the second door 234 are coupled to the first side 214 and the second side 216 respectively via respective slow self-closing hinges 244 (e.g., slow closing hydraulic hinges shown in FIG. 5). The respective slow closing hinges 244 are configured to respectively enable, upon opening to the open position, the first door 232 and the second door 234 to self-close at a rate that provides enough time for the forks of the jacket pallet to access the central space 236 but does not provide enough time for the forks of the forklift to access the central space 236.

The first stopper structure 226 and second stopper structure 228 (along their longitudinal lengths) are in parallel alignment with both the first door 232 and the second door 234. The first stopper structure 226 is disposed closer to the first door 232 than the second stopper structure 228. The second stopper structure 228 is disposed closer to the second door 234 than the first stopper structure 226. The first stopper structure 226 and the second stopper structure 228 each have substantially similar lengths (e.g., approximately 95 percent to 100 percent) to the lengths of the first door 232 and the second door 234, respectively, in the direction 230 extending between the third side 218 and the fourth side 220.

In some cases, an operator may force the forks of the forklift beyond the either the first door 232 or the second door 234 into the central space 236. Both the first stopper structure 226 and the second stopper structure 228 are configured to block full access to the forks of the forklift in a direction 246 extending between the first side 214 and the second side 216. In particular, the first stopper structure 226 and the second stopper structure 228 keep the forks of the forklift from extending across a majority of a length of central space 236, thus, keeping the forklift from being able to lift and transport safely the high center of gravity of load 202. In certain embodiments, as described in greater detail below, mechanisms may be utilized in conjunction with the first stopper structure 226 and the second stopper structure 228 to help block full access to the forks of the forklift even if the operator attempts to force the forks of the forklift under either the first stopper structure 226 and the second stopper structure 228.

The configuration of the pallet 200 ensures that forks of the forklift are inserted into pallet 200 only at the widest possible zone (e.g., spaces 242) by blocking the central portion (e.g., central space 236) using a swing type blocking door. (e.g., first door 232 or second door 234). This blocking door also opens out when a transport team needs to use a pallet jack. The door also has a slow (e.g., delayed) closing hinge (e.g., hinge 244) to provide sufficient time for a pallet jack operator to insert forks below the pallet. The disclosed embodiments enable high center of gravity loads 202 to be transported without tipping. Thus, the providers of equipment with a high center of gravity, such as medical imaging systems, reduce costs associated with equipment damaged during transport.

Figures 6, 7, 8:
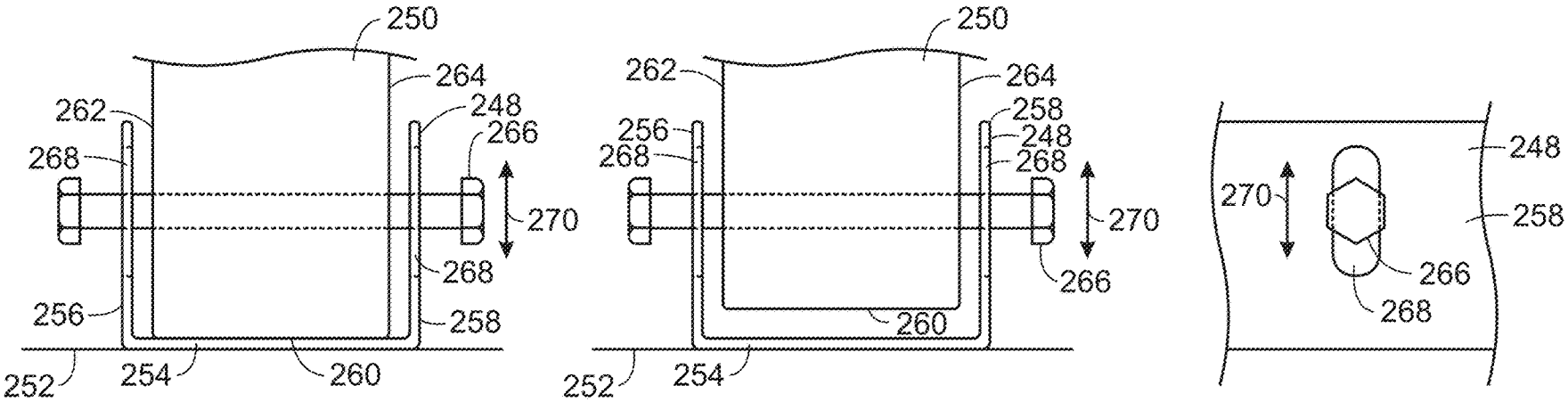
FIG. 6 is a schematic diagram of an end view of a U-shaped metal casing disposed about a stopper structure (e.g., with the pallet one the ground), in accordance with aspects of the present disclosure.
FIG. 7 is a schematic diagram of an end view of the U-shaped metal casing disposed about the stopper structure in FIG. 6 (e.g., with the pallet at least partially lifted), in accordance with aspects of the present disclosure.
FIG. 8 is a schematic diagram of a side view of the U-shaped metal casing in FIGS. 6 and 7, in accordance with aspects of the present disclosure.

As mentioned above, mechanisms may be utilized in conjunction with the first stopper structure 226 and the second stopper structure 228 to help block full access to the forks of the forklift even if the operator attempts to force the forks of the forklift under either the first stopper structure 226 and the second stopper structure 228. FIG. 6 is a schematic diagram of an end view of a U-shaped metal casing 248 disposed about stopper structure 250 (e.g., first stopper structure 226 or second stopper structure 228) (e.g., with the pallet (e.g., pallet 200) disposed on the ground or surface 252). FIG. 7 is a schematic diagram of an end view of the U-shaped metal casing 248 disposed about stopper structure 250 (e.g., first stopper structure 226 or second stopper structure 228) (e.g., with the pallet (e.g., pallet 200) at least partially lifted). FIG. 8 is a schematic diagram of a side view of the U-shaped metal casing 248 in FIGS. 6 and 7.

The U-shaped metal casing 248 has a bottom side 254 and sides 256, 258 (e.g., lateral sides) flanking the bottom side 254 forming a U shape. As depicted in FIGS. 6 and 7, the bottom side 254 is disposed below an underside 260 of the stopper structure 250 and sides 256, 258 are respectively disposed about sides 262, 264 (lateral sides). The U-shaped metal casing 248 is fastened to the stopper structure 250 via a fastener 266 (e.g., nut and bolt) that extends through the stopper structure 250. The fastener 266 extends through corresponding slots 268 in the sides 256, 258. The slots 268 is configured to enable the U-shaped metal casing 248 to move in a vertical direction 270 relative to the stopper structure 250. As depicted in FIG. 6, when the pallet is not being lifted (i.e., the pallet is located on the ground or surface 252), the bottom side 254 of the U-shaped metal casing 248 contacts the ground or surface 252 and the bottom side 254 of the U-shaped metal casing 248 also contacts the underside of the stopper structure 250. As depicted in FIG. 7, when the pallet is at least partially lifted, the bottom side 254 of the U-shaped metal casing 248 remains in contact with the ground or surface 252, while the stopper structure 250 is displaced in the vertical direction 270 relative to the ground or surface 252. Keeping the bottom side 254 of the U-shaped metal casing 248 in contact with the ground or surface 252 keeps the forks of the forklift from being forced under the stopper structure 250 by the operator.

Figure 10:
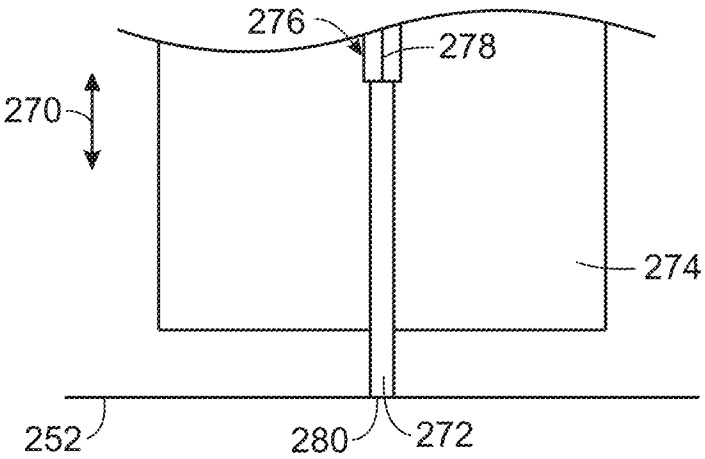
FIG. 10 is a schematic diagram of an end view of the metal plate disposed in the stopper structure (e.g., with pallet at least partially lifted), in accordance with aspects of the present disclosure.
Figure 9:
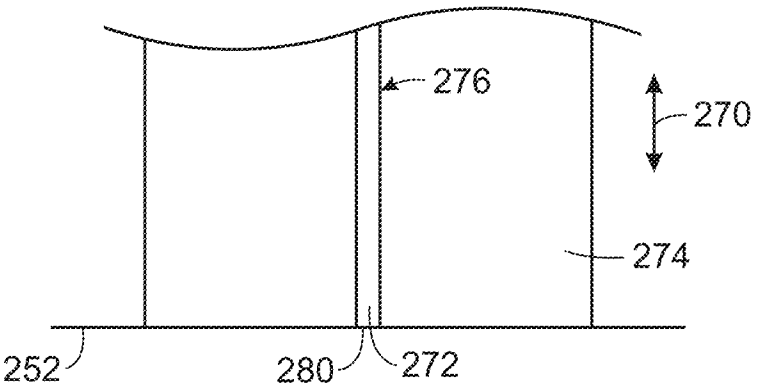
FIG. 9 is a schematic diagram of an end view of a metal plate disposed in a stopper structure (e.g., with the pallet on the ground), in accordance with aspects of the present disclosure.

Other mechanisms may be utilized in conjunction with the first stopper structure 226 and the second stopper structure 228 to help block full access to the forks of the forklift even if the operator attempts to force the forks of the forklift under either the first stopper structure 226 and the second stopper structure 228. FIG. 9 is a schematic diagram of an end view of a metal plate 272 disposed within a stopper structure 274 (e.g., first stopper structure 226 or second stopper structure 228) (e.g., with the pallet (e.g., pallet 200) disposed on the ground or surface 252). FIG. 10 is a schematic diagram of an end view of the metal plate 272 disposed within the stopper structure 274 (e.g., first stopper structure 226 or second stopper structure 228) (e.g., with the pallet (e.g., pallet 200) at least partially lifted).

The metal plate 272 is disposed within a slot 276 of the stopper structure 274. The metal plate 272 extends in the vertical direction 270. The metal plate 272 is fastened to a top portion of the slot 276 via a chain 278 (or similar mechanism) fastened to the top portion of the slot 276 via a fastener (not shown). The coupling of the metal plate 272 within the slot 276 is configured to enable the metal plate 272 to move in the vertical direction 270 relative to the stopper structure 274. As depicted in FIG. 9, when the pallet is not being lifted (i.e., the pallet is located on the ground or surface 252), a bottom 280 of the metal plate 272 contacts the ground or surface 252. As depicted in FIG. 10, when the pallet is at least partially lifted, the bottom 280 of the metal plate 272 remains in contact with the ground or surface 252, while the stopper structure 274 is displaced in the vertical direction 270 relative to the ground or surface 252. Keeping the bottom 280 of the metal plate 272 in contact with the ground or surface 252 keeps the forks of the forklift from being forced under the stopper structure 274 by the operator.

Figure 11:
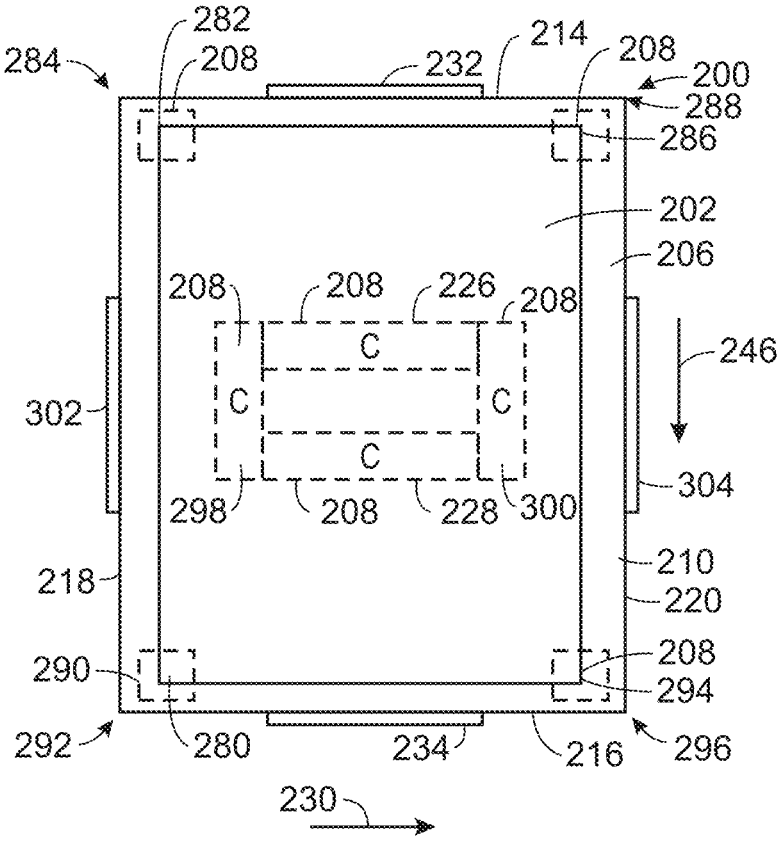
FIG. 11 is a schematic diagram of a top view of a pallet (e.g., having four doors), in accordance with aspects of the present disclosure.

In certain embodiments, each side of the pallet may include a door. FIG. 11 is a schematic diagram of a top view of the pallet 200 (e.g., having four doors). The pallet 200 includes the deck 206 and the plurality of support structures 208. The pallet 200 includes the top side 210 and the underside 212. The plurality of support structures 208 are coupled to the underside 212 of the deck 206 and are configured to be disposed on the ground or a surface. The high center of gravity load 202 is disposed on the top side 210 of the deck 206. The plurality of support structures 208 are configured to support the deck 206 and the high center of gravity load 202.

The deck 206 has the first side 214, the second side 216 disposed opposite the first side 214, the third side 218, and the fourth side 220 disposed opposite the third side 218. Both the first side 214 and the second side 216 extend between both third side 218 and the fourth side 220. As depicted, both the first side 214 and the second side 216 are narrower than both third side 218 and the fourth side 220. In certain embodiments, the first side 214, the second side 216, the third side 218, and the fourth side 220 are the same length. In certain embodiments, both the third side 218 and the fourth side 220 are narrower than the first side 214 and the second side 216.

The plurality of support structures 208 includes a first support structure 282 disposed in a corner 284 adjacent to the first side 214 and the third side 218 underneath the deck 206. The plurality of support structures 208 also includes a second support structure 286 disposed in a corner 288 adjacent to the first side 214 and the fourth side 220 underneath the deck 206. The plurality of support structures 208 further includes a third support structure 290 disposed in a corner 292 adjacent to the second side 216 and the third side 218 underneath the deck 206. The plurality of support structures 208 includes a fourth support structure 294 disposed in a corner 296 adjacent to the third side 218 and the fourth side 220 underneath the deck 206. The number of support structures 208, the placement of the support structures 208, and the length of the support structures 208 may vary from those depicted in FIG. 11.

The plurality of support structures 208 also includes the first stopper structure 226 (e.g. first stopper block represented by C) centrally located on the underside 212 of the deck 206. The plurality of support structures 208 further includes the second stopper structure 228 (e.g., second stopper block represented by C) centrally located on the underside 212 of the deck 206. The first stopper structure 226 and the second stopper structure 228 are oriented with their respective longitudinal lengths extending in a direction 230 between the third side 218 and the fourth side 220. The first stopper structure 226 and second stopper structure 228 (along their longitudinal lengths) are in parallel alignment with both the first side 214 and the second side 216. The first stopper structure 226 is disposed closer to the first side 214 than the second stopper structure 228. The second stopper structure 228 is disposed closer to the second side 216 than the first stopper structure 226. The plurality of support structures 208 further includes a third stopper structure 298 (e.g., third stopper block represented by C) centrally located on the underside 212 of the deck 206. The plurality of support structures 208 yet further includes the fourth stopper structure 300 (e.g., fourth stopper block represented by C) centrally located on the underside 212 of the deck 206. The third stopper structure 298 and the fourth stopper structure 300 are oriented with their respective longitudinal lengths extending in a direction 246 between the first side 214 and the second side 216. The third stopper structure 298 and fourth stopper structure 300 (along their longitudinal lengths) are in parallel alignment with both the third side 218 and the fourth side 220. The third stopper structure 298 is disposed closer to the third side 218 than the fourth stopper structure 300. The fourth stopper structure 300 is disposed closer to the fourth side 220 than the third stopper structure 298. In certain embodiments, the first stopper structure 226, the second stopper structure 228, the third stopper structure 298, and the fourth stopper structure 300 may a single piece (e.g., square-shaped stopper structure).

As depicted, the pallet 200 includes the first door 232 (e.g., first slow self-closing door) coupled to and centrally disposed along the first side 214. The pallet 200 also includes the second door 234 (e.g., second slow self-closing door) coupled to and centrally disposed along the second side 216. The pallet 200 further includes a third door 302 (e.g., third slow self-closing door) coupled to and centrally disposed along the third side 218. The pallet 200 even further includes a fourth door 304 (e.g., fourth slow self-closing door) coupled to and centrally disposed along the fourth side 220. Each of the first door 232, the second door 234, the third door 302, and the fourth door 304 are configured to move between an open position and a closed position as described above. In the closed position, the first door 232, the second door 234, the third door 302, and the fourth door 304 are each configured to block forks of a forklift from accessing a central space (e.g., relative to where the door is located) underneath the deck 206. The central space is unstable for lifting the high center of gravity load 202 with the forklift. In the open position, the first door 232, the second door 234, the third door 302, and the fourth door 304 are each configured to enable forks of a pallet jack to access the central space for transport of the high center of gravity load 202 on pallet 200 by the pallet jack.

When the first door 232, the second door 234, the third door 302, and the fourth door 304 is in the closed position only spaces flanking the respective door are available to the forks of the forklift to be inserted underneath the deck 206. These spaces when utilized or accessed by the forks of the forklift are stable for lifting the high center of gravity load 202 and transporting the high center of gravity load 202 with the forklift.

The first door 232, the second door 234, the third door 302, and the fourth door 304 are each coupled to the first side 214, the second side 216, third side 218, and the fourth side 220 respectively via respective slow self-closing hinges (e.g., slow closing hydraulic hinges 244 shown in FIG. 5). The respective slow closing hinges are configured to respectively enable, upon opening to the open position, the first door 232, the second door 234, the third door 302, and the fourth door 304 to self-close at a rate that provides enough time for the forks of the jacket pallet to access the central space but does not provide enough time for the forks of the forklift to access the central space.

The first stopper structure 226 and the second stopper structure 228 (along their longitudinal lengths) are in parallel alignment with both the first door 232 and the second door 234 but arranged cross-wise (or orthogonal) with respect to both the third door 302 and the fourth door 304. The third stopper structure 298 and the fourth stopper structure 300 (along their longitudinal lengths) are in parallel alignment with both the first door 232 and the second door 234 but arranged cross-wise (or orthogonal) with respect to both the third door 302 and the fourth door 304. The first stopper structure 226 is disposed closer to the first door 232 than the second stopper structure 228. The second stopper structure 228 is disposed closer to the second door 234 than the first stopper structure 226. The third stopper structure 298 is disposed closer to the third door 302 than the fourth stopper structure 300. The fourth stopper structure 300 is disposed closer to the fourth door 304 than the third door 302. The first stopper structure 226 and the second stopper structure 228 each have substantially similar lengths (e.g., approximately 95 percent to 100 percent) to the lengths of the first door 232 and the second door 234, respectively, in the direction 230 extending between the third side 218 and the fourth side 220. The third stopper structure 298 and the fourth stopper structure 300 each have substantially similar lengths (e.g., approximately 95 percent to 100 percent) to the lengths of the third door 302 and the fourth door 304, respectively, in the direction 246 extending between the first side 214 and the second side 216.

In some cases, an operator may force the forks of the forklift beyond the either the first door 232, the second door 234, the third door 302, or the fourth door 304 into the central space. Both the first stopper structure 226 and the second stopper structure 228 are configured to block full access to the forks of the forklift in the direction 246 extending between the first side 214 and the second side 216. Both the third stopper structure 298 and the fourth stopper structure 300 are configured to block full access to the forks of the forklift in the direction 230 extending the third side 218 and the fourth side 220. In particular, the first stopper structure 226, the second stopper structure 228, the third stopper structure 298, and the fourth stopper structure 300 keep the forks of the forklift from extending across a majority of a length of central space, thus, keeping the forklift from being able to lift and transport safely the high center of gravity of load 202. In certain embodiments, as described above, mechanisms may be utilized in conjunction with the first stopper structure 226, the second stopper structure 228, the third stopper structure 298 and the fourth stopper structure 300 to help block full access to the forks of the forklift even if the operator attempts to force the forks of the forklift under the first stopper structure 226, the second stopper structure 228, the third stopper structure 298, or the fourth stopper structure 300.

FIG. 12 is a schematic diagram of a side view of a pallet with an imaging system 10 disposed on a pallet 200. As mentioned with reference to FIGS. 1-3, the pallet 200 includes a deck 206 and a plurality of support structures 208. The pallet 200 includes a top side 210 and an underside 212. The plurality of support structures 208 are coupled to the underside 212 of the deck 206 and are configured to be disposed on the ground or a surface. The imaging system 10 is disposed on the top side 210 of the deck 206. The plurality of support structures 208 are configured to support the deck 206 and the heavy unbalanced high center of gravity imaging system 10.

The deck 206 has a first side 214, a second side 216 disposed opposite the first side 214, a third side 218, and a fourth side 220 disposed opposite the third side 218. Both the first side 214 and the second side 216 extend between both the third side 218 and the fourth side 220.

The plurality of support structures 208 also includes a first stopper structure 226 (e.g., first stopper block represented by C) centrally located on the underside 212 of the deck 206. The plurality of support structures 208 further includes a second stopper structure 228 (e.g., second stopper block represented by C) centrally located on the underside 212 of the deck 206.

The imaging system 10 includes a very heavy high center of gravity gantry 12 and a table assembly 14 coupled to the gantry 12. The gantry 12 may include an imaging source, imaging detector assembly, a magnet assembly, and other heavy components. The table assembly 14 includes a base 16, a lifting and movement assembly 18, a table top 20 coupled to the lifting and movement assembly 18, and a cradle (not shown) coupled to the table top 20 for moving a subject to be imaged into and out of a bore (not shown) extending through a middle of the gantry 12. Such an imaging system 10 is a very heavy unbalanced load with a high center of gravity that needs to be moved and transported during manufacturing, installation, and removal that is an example of a high center of gravity load for the pallet of the present disclosure.

Technical effects of the disclosed embodiments include providing for a pallet (e.g., pallet) configured for the safe lifting of high center of gravity loads. Examples of high center of gravity loads include equipment of a computed tomography imaging system, a magnetic resonance imaging system, or other imaging systems having equipment high center of gravity loads. The configuration of the pallet ensures that forks of a forklift are inserted into pallet only at the widest possible zone by blocking the central portion using a swing type blocking door. This blocking door also opens out when a transport team needs to use a pallet jack. The door also has a slow (e.g., delayed) closing hinge to provide sufficient time for a pallet jack operator to insert forks below the pallet. The technical effects of the disclosed embodiments also enable high center of gravity loads to be transported without tipping. Thus, the providers of equipment of medical imaging equipment reduce costs associated with equipment damaged during transport. Technical effects of the disclosed embodiments further include making it easier and safer to transport high center of gravity loads when a location lacks a loading dock. Technical effects of the disclosed embodiments further enable the unloading of the high center of gravity load from a side or a back of a trailer having the pallet with the high center of gravity load.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

This written description uses examples to disclose the present subject matter, including the best mode, and also to enable any person skilled in the art to practice the subject matter, including making and using any apparatus, devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A pallet configured for a high center of gravity load, comprising:

a deck having a first side, a second side disposed opposite the first side, a third side, and a fourth side disposed opposite the third side, and wherein both the first side and the second side extend between both the third side and the fourth side;

a plurality of support structures coupled to and disposed underneath the deck; and a first door coupled to and centrally disposed along the first side; and a second door coupled to and centrally disposed along the second side, wherein the first door and the second door are each configured to move between an open position and a closed position, the closed position being configured to block forks of a forklift from accessing a central space underneath the deck that is unstable for lifting the high center of gravity load disposed on the pallet with the forklift, and the open position being configured to enable forks of a pallet jack to access the central space, and wherein both the first door and the second door in the open position extend outward from the deck and are substantially aligned with the deck.

2. The pallet of claim 1, wherein both the first side and the second side are narrower than both the third side and the fourth side.

3. The pallet of claim 1, wherein both first door and the second door are coupled to the first side and the second side respectively via respective slow self-closing hinges, wherein the respective slow self-closing hinges are configured to respectively enable, upon opening to the open position, the first door and the second door to self-close at a rate that provides enough time for the forks of a jacket pallet to access the central space but does not provide enough time for the forks of the forklift to access the central space.

4. The pallet of claim 1, wherein when either the first door or the second door is in the closed position only spaces flanking the first door or the second door underneath the deck are available to the forks of the forklift, and wherein the spaces when accessed by the forks of the forklift are stable for lifting the high center of gravity load with the forklift.

5. The pallet of claim 1, wherein the support structures comprise a first stopper structure centrally located underneath the deck and a second stopper structure centrally located underneath the deck, wherein the first stopper structure and the second stopper structure are located closer to the first door and the second door respectively, the first stopper structure and the second stopper structure are respectively aligned in parallel with the first door and the second door, and wherein both the first stopper structure and the second stopper structure are configured to block full access to the forks of the forklift in a direction extending between the first side and the second side in the central space underneath the deck.

6. The pallet of claim 5, wherein the first stopper structure and the second stopper structure each have substantially similar lengths to the first door and the second door, respectively, in a direction between the third side and the fourth side.

7. The pallet of claim 5, further comprising a first U-shaped metal casing disposed about a first underside and a first pair of lateral sides flanking the first underside of the first stopper structure, and a second U-shaped metal casing disposed about a second underside and a second pair of lateral sides flanking the second underside of the second stopper structure.

8. The pallet of claim 7, wherein both the first U-shaped metal casing and the second U-shaped metal casing are configured to lower with respect to the first stopper structure and the second stopper structure to contact a surface the pallet is disposed on upon lifting of the pallet to block the forks of the forklift from extending underneath the first stopper structure and the second stopper structure respectively.

9. The pallet of claim 5, further comprising a first metal plate disposed within the first stopper structure and a second metal plate disposed within the second stopper structure, wherein both the first metal plate and the second metal plate are configured to contact a surface the pallet is disposed on upon lifting of the pallet to block the forks of the forklift from extending underneath the first stopper structure and the second stopper structure respectively.

10. The pallet of claim 1, wherein the high center of gravity load comprises equipment of a computed tomography imaging system or a magnetic resonance imaging system.

11. A pallet configured for a high center of gravity load, comprising:

a deck having a first side, a second side disposed opposite the first side, a third side, and a fourth side disposed opposite the third side, and wherein both the first side and the second side extend between both third side and the fourth side;

a plurality of support structures coupled to and disposed underneath the deck;

a first door coupled to and centrally disposed along the first side; and a second door coupled to and centrally disposed along the second side, wherein the first door and the second door are each configured to move between an open position and a closed position, wherein both first door and the second door are coupled to the first side and the second side respectively via respective slow self-closing hinges, wherein the respective slow self-closing hinges are configured to respectively enable, upon opening to the open position, the first door and the second door to self-close at a rate that provides enough time for forks of a jacket pallet to access a central space underneath the deck but does not provide enough time for forks of a forklift to access the central space, and wherein the central space is unstable for lifting the high center of gravity load disposed on the pallet with the forklift, and wherein both the first door and the second door in the open position extend outward from the deck and are substantially aligned with the deck.

12. The pallet of claim 11, wherein the closed position is configured to block the forks of the forklift from accessing the central space underneath the deck with the forklift, and the open position is configured to enable the forks of a pallet jack to access the central space.

13. The pallet of claim 11, wherein when either the first door or the second door is in the closed position only spaces flanking the first door or the second door underneath the deck are available to the forks of the forklift, and wherein the spaces when accessed by the forks of the forklift are stable for lifting the high center of gravity load with the forklift.

14. The pallet of claim 11, wherein the support structures comprise a first stopper structure centrally located underneath the deck and a second stopper structure centrally located underneath the deck, wherein the first stopper structure and the second stopper structure are located closer to the first door and the second door respectively, the first stopper structure and the second stopper structure are respectively aligned in parallel with the first door and the second door, and wherein both the first stopper structure and the second stopper structure are configured to block full access to the forks of the forklift in a direction extending between the first side and the second side in the central space underneath the deck.

15. The pallet of claim 14, wherein the first stopper structure and the second stopper structure each have substantially similar lengths to the first door and the second door, respectively, in a direction between the third side and the fourth side.

16. The pallet of claim 14, further comprising a first U-shaped metal casing disposed about a first underside and a first pair of lateral sides flanking the first underside of the first stopper structure, and a second U-shaped metal casing disposed about a second underside and a second pair of lateral sides flanking the second underside of the second stopper structure.

17. The pallet of claim 16, wherein both the first U-shaped metal casing and the second U-shaped metal casing are configured to lower with respect to the first stopper structure and the second stopper structure to contact a surface the pallet is disposed on upon lifting of the pallet to block the forks of the forklift from extending underneath the first stopper structure and the second stopper structure respectively.

18. The pallet of claim 14, further comprising a first metal plate disposed within the first stopper structure and a second metal plate disposed within the second stopper structure, wherein both the first metal plate and the second metal plate are configured to contact a surface the pallet is disposed on upon lifting of the pallet to block the forks of the forklift from extending underneath the first stopper structure and the second stopper structure respectively.

19. The pallet of claim 11, wherein the high center of gravity load comprises equipment of a computed tomography imaging system or a magnetic resonance imaging system.

20. A pallet configured for equipment of a medical imaging system having a high center of gravity, comprising:

a deck having a first side, a second side disposed opposite the first side, a third side, and a fourth side disposed opposite the third side, and wherein both the first side and the second side extend between both third side and the fourth side;

a plurality of support structures coupled to and disposed underneath the deck, wherein the plurality of support structures comprise:

a first door coupled to and centrally disposed along the first side; and a second door coupled to and centrally disposed along the second side, wherein the first door and the second door are each configured to move between an open position and a closed position, wherein the support structures comprise a first stopper structure centrally located underneath the deck and a second stopper structure centrally located underneath the deck, wherein the first stopper structure and the second stopper structure are located closer to the first door and the second door respectively, the first stopper structure and the second stopper structure are respectively aligned in parallel with the first door and the second door, and wherein both the first stopper structure and the second stopper structure are configured to block full access to forks of a forklift in a direction extending between the first side and the second side in a central space underneath the deck, and wherein both the first door and the second door in the open position extend outward from the deck and are substantially aligned with the deck.

* * * * *